US005612508A

United States Patent [19]

Kasper

[11] Patent Number: 5,612,508

[45] Date of Patent: Mar. 18, 1997

[54] FLEXIBLE JUMPER AND METHOD OF MAKING

[75] Inventor: James J. Kasper, Sheffield Village, Ohio

[73] Assignee: Watteredge-Uniflex, Inc., Avon Lake, Ohio

[21] Appl. No.: 398,885

[22] Filed: Mar. 6, 1995

[51] Int. Cl.[6] ..... H01B 7/34

[52] U.S. Cl. ..... 174/15.6; 174/15.7; 174/19

[58] Field of Search ..... 174/15.6, 74 R, 174/15.7, 19, 75 R

[56] References Cited

U.S. PATENT DOCUMENTS

| | | | |
|---|---|---|---|
| 1,674,829 | 6/1928 | La Bean . | |
| 3,909,501 | 9/1975 | Johnsen | 174/15 C X |
| 4,006,287 | 2/1977 | Storey | 174/15 WF X |
| 4,607,133 | 8/1986 | Alloin et al. | 174/15 WF X |
| 5,004,865 | 4/1991 | Krupnicki | 174/15.7 |
| 5,229,543 | 7/1993 | Strefling | 174/15.6 |

*Primary Examiner*—Kristine L. Kincaid
*Assistant Examiner*—Chau N. Nguyen
*Attorney, Agent, or Firm*—Renner, Otto, Boisselle, Sklar

[57] ABSTRACT

A flexible jumper is made by arranging a series of stranded conductors around a hollow core, placing a sleeve over the ends of the arranged conductors and then crimping the sleeve and conductors to provide a more dense conductor annulus between the sleeve and core. The solidified and concentric circularized conductor ends are soldered into a socket of respective terminations without the solder wicking up the conductors. A hose is sealed to each termination and water is circulated through the jumper. The jumper is more efficient, easier to make, and has a longer service life.

23 Claims, 1 Drawing Sheet

FLEXIBLE JUMPER AND METHOD OF MAKING

DISCLOSURE

This invention relates generally as indicated to a flexible jumper, and more particularly to an improved water cooled flexible jumper and method.

BACKGROUND OF THE INVENTION

Water cooled flexible jumpers are widely used in a variety of applications such as welders, or other machines usually having relatively movable parts.

Such jumpers are conventionally made by cutting conductor stranding to length, installing a core such as a spring, and then soldering the stranding into a socket in a machined copper termination. The termination has a fitting which telescopes into the spring core end. The jumper is inserted into a hose which is sealed to each termination, and water can be circulated through the jumper.

Usually the conductor stranding is a series of individual stranded copper cables arranged around the core spring. The cables are placed adjacent each other in circular fashion around the central core spring. It may take a number of such cables completely to surround the core spring. Such cables are difficult to assemble and solder, and moreover, solder tends to wick up the strands providing irregular stress concentrations at or near the termination, which may cause premature failure of the jumper.

It would accordingly be advantageous to have a flexible jumper which is easier to make and assemble accurately, and which avoids the solder wick up problem, all providing an improved flexible jumper with a longer service life.

SUMMARY OF THE INVENTION

In the present invention, the conductor stranding is cut to length, and arranged around a hollow core such as a spring. A conductor tube such as a copper tube or sleeve is slipped on the end of the stranding. The tube or sleeve and stranding end is then crimped by a multifaceted die to a predetermined diameter which is slightly smaller than the socket in the termination. The crimping action not only reduces the diameter of the conductor sleeve but distributes and compacts the conductor stranding to form a uniform high density strand annulus between the sleeve and spring core.

After crimping, the end is cut to length to provide a true circular end face and the crimped solid end is soldered into the socket of the termination. The process is repeated at the opposite end. Each termination is provided with a riser tube which telescopes into the core and after the jumper is provided with a hose sealed to each termination, water may be circulated through the jumper.

The crimping and solidification process not only provides an improved electrical connection but also prevents the noted solder wick up.

During the crimping process, the inner end of the core which is away from the termination is preferable flared to avoid stress concentrations on the stranding, and a plastic tube may be captured by the flared end of the crimped conductor tube, further improving jumper life.

During the crimping process, the facets of the crimping die solidifying the end of the stranding will form slight axial pockets or depressions on the exterior of the conductor sleeve, which are separated by slight axial ridges. When inserted into the socket of the termination, the pockets will fill with solder and any excess will flow outside the conductor sleeve where it can easily be removed. A better more uniform solder connection is made.

The present invention thus provides an improved jumper with a longer service life, but also one which can more easily be made.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
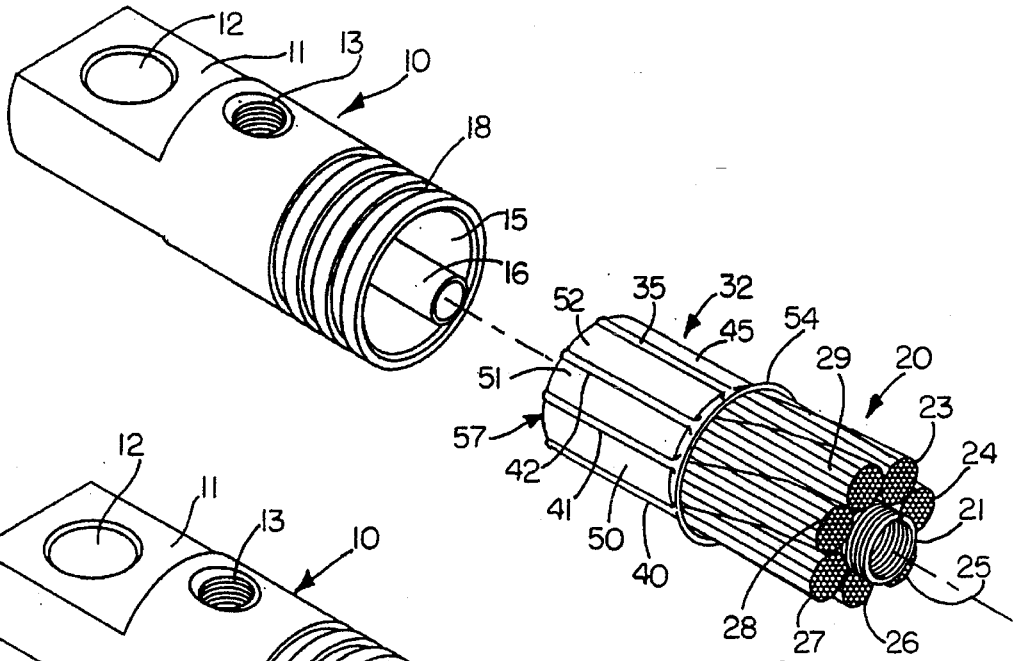
FIG. 1 is an exploded view of one process in accordance with the present invention.

Referring initially to FIG. 1, there is illustrated the components at one end of a flexible jumper in accordance with the present invention. Although only one end of the jumper will be shown and its construction described, it will be appreciated that the opposite end of the jumper will be made in the same way. The flexible water cooled jumpers of the present invention may vary widely in length and will normally have similar or identical terminations at each end. The jumper will normally be encased in a hose which is sealed to each termination and each termination will normally be provided with a water port for circulation of cooling water through the jumper. However, some aspects of the present invention are equally applicable to other forms of high current capacity flexible jumpers and cables.

As seen in FIG. 1, the termination shown generally at 10 is usually machined from a copper block and provides a flat clamping pad 11 on its end so that the termination may be clamped with suitable fasteners through hole 12. The termination is provided with a water port 13 and an axially extending blind cylindrical socket 15. Projecting centrally from the socket 15 is a riser tube 16 which is in communication with the water port 13. The exterior of the termination around the socket 15 is provided with a plurality of annular grooves 18 to which one end of an abrasion resistant hose is clamped through which the jumper will extend when completed.

The jumper itself is formed of a plurality of conductors indicated generally at 20 which are arranged around a hollow flexible core 21 which as illustrated is in the form of a coil spring. The conductors illustrated are in the form of stranded copper cables. The conductors are initially arranged around the hollow core as close together as they can be positioned and it will be seen that there are seven such cables in the illustrated embodiment, as seen at 23, 24, 25, 26, 27, 28 and 29. The position of these stranded cables around the center hollow coil spring core is perhaps more easily seen in FIG. 3.

Figure 3:
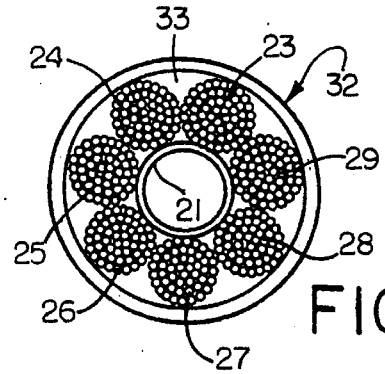
FIG. 3 is a stranding end elevation before crimping.
Figure 4:
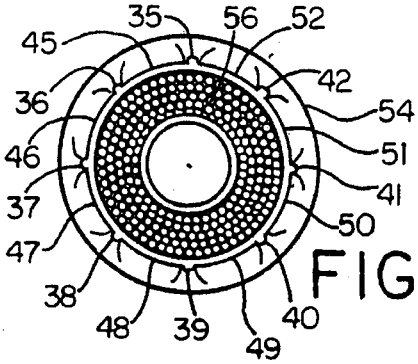
FIG. 4 is a similar view after crimping.

After the cables are arranged in the manner indicated, a conductor sleeve seen at 32 is slipped over the ends of the stranding. Initially, it will be seen that even though the individual stranded cables abut each other around the hollow core, there is nonetheless significant space between the cables as seen at 33 in FIG. 3. The sleeve 32 is a conductive material such as copper and may be tinned before assembly. After the sleeve is in position as seen in FIG. 3, the now contained conductor ends are placed in a crimping die and the sleeve and cable ends are constricted as seen in FIG. 4.

The crimping die is provided with a series of radially moveable circular segments driven inwardly usually by a cone wedge which can readily be axially aligned with the center of the core. Thus, linear movement of the wedge will drive the crimping segments radially inwardly and adjustable stops may provide the final desired position.

It is noted that as the die segments are driven radially inwardly, they form small ridges on the exterior of the sleeve 32. These small ridges which are formed between the crimping die segments during the crimping process are shown somewhat exaggerated in FIGS. 1 and 4, 35, 36, 37, 38, 39, 40, 41 and 42. Between such ridges the crimping die segments form shallow pockets seen at 45, 46, 47, 48, 49, 50, 51 and 52. Again, these shallow pockets are shown somewhat exaggerated.

It is noted that not the entire axial length of the conductor sleeve 32 is positioned in the crimping die. The inner edge away from the termination 10 is left uncrimped and permitted to flare as indicated at 54 in FIGS. 1 and 4. This provides a rounded well radiused interior surface between the crimped and uncrimped portion of the conductor sleeve and avoids sharp edges or stress points which might bear against the conductor stranding. The shape of the flaring may be partially formed by the crimping operation.

As seen more clearly in FIG. 4, the crimping of the conductor sleeve 32 not only reduces the sleeve in diameter but rearranges the copper stranding of the cabling inside into a more dense solidified annulus as seen at 56 in FIG. 4. After the solidification process, there are no large voids in the copper stranding which would wick up solder. After the conductor sleeve is compressed or crimped as seen in FIG. 1 and the conductor strands rearranged and solidified as seen more clearly in FIG. 4, the crimped solid end may then be cut transversely to provide a circular true end face 57 which is facing away from the viewer in FIG. 1. The cutting to length of the crimped end of the conductor cabling also has the effect of smearing the relatively soft copper material so that the circular end face has the appearance of a solid block of copper and the individual strands and the demarkation with the sleeve 32 are no longer readily visible.

After the end of the conductor cabling is prepared in this fashion, the crimped reduced diameter and solidified end of the cabling is soldered into the socket 15 of the termination 10. The riser tube 16 telescopes into the hollow core 21. The treatment of the end face as described allows the solder to flood and fill the pockets between the interior wall of the socket 15 and the exterior of the conductor sleeve. Any excess solder can readily be removed and the solder does not wick up through the stranding of the cabling to provide stress points when the cable flexes.

The opposite end of the jumper is formed in the same way. The stranded conductors are spiraled around the hollow core and a conductor sleeve is inserted on the opposite end to be crimped, cut to length, and soldered into the opposite terminal. The entire assembly is then threaded into a hose such as partially seen at 60 in FIG. 5. The ends of the hose are clamped and sealed to the respective terminations by means of conventional hose clamps, for example, at the annular grooves 18. In this manner, water may then be circulated through the flexible jumper.

Figure 2:
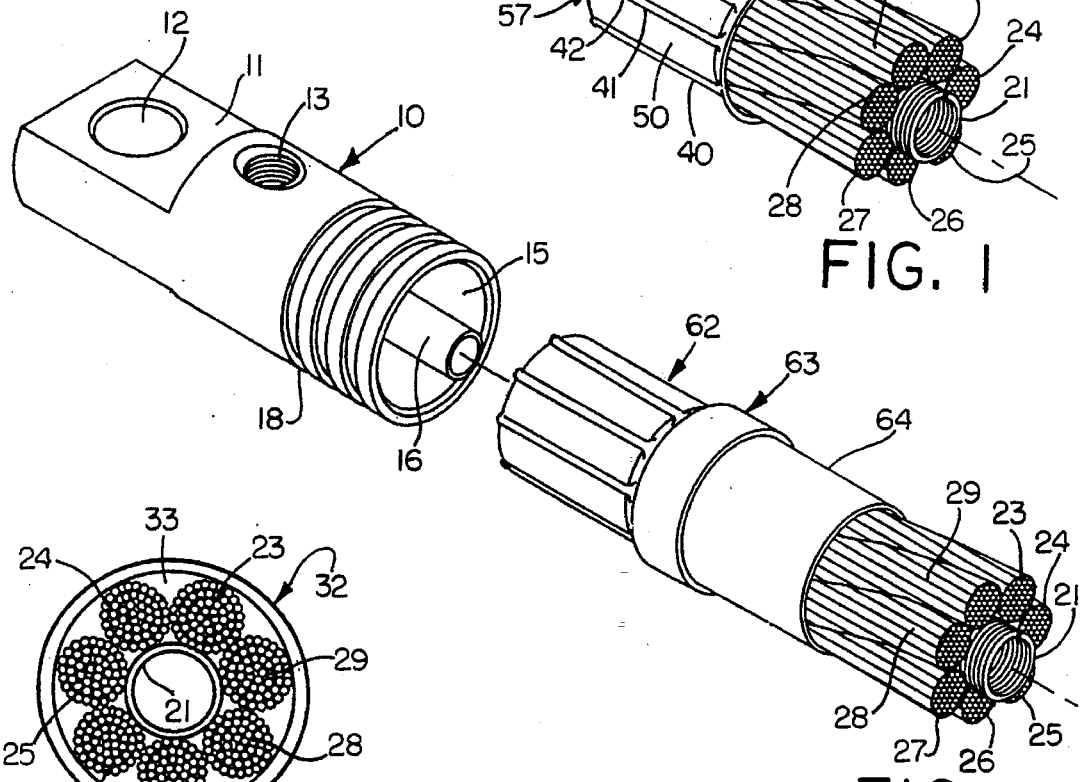
FIG. 2 is a similar exploded view of a slightly modified process using a conductor sleeve and a plastic sleeve.
Figure 5:
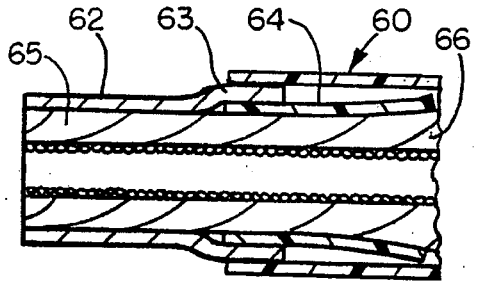
FIG. 5 is an axial fragmentary section through the conductor sleeve and plastic sleeve of the FIG. 2 embodiment.

Referring now to FIGS. 2 and 5, there is illustrated another embodiment of the present invention. The conductor sleeve 62 on the end of the stranded cabling is somewhat axially longer than the sleeve 32 and the flared end away from the termination 10 forms a skirt 63 which captures a one end of a plastic sleeve 64 which extends axially further around the cabling surrounding the hollow core 21.

The skirt 63 is also crimped or constricted during the crimping process, but to a lesser degree, gripping the underlying end of the plastic sleeve 64. The plastic sleeve is preferably TEFLON® which is a registered trademark of E.I. DuPont de Nemours & Co., Inc. of Wilmington, Del. TEFLON is fluorocarbon resin which has the characteristics of toughness and surface lubricity to provide a transition section for the stranded cabling between the crimped conductor sleeve 62 and the uncrimped major section of the cabling between terminations. As can be seen more clearly in FIG. 5, the plastic sleeve 64 permits a gradual expansion of the cabling from the solidified section within the crimped conductor sleeve seen at 65 to the unsolidified major center section 66. Otherwise, the flexible jumper seen in FIGS. 2 and 5 is made and constructed in the same way as the jumper of FIGS. 1, 3 and 4.

It can now be seen that there is provided a method of making a flexible jumper which includes the steps of placing a conductor sleeve over the ends of the arranged conductors and then crimping the sleeve to reduce the diameter thereof and also to arrange the conductors in a more compact or solidified generally uniform annulus at each end. This greatly facilitates the soldering of the conductors into the termination socket preventing solder wick up. The invention provides a higher capacity lower impedance jumper while at the same time providing a jumper which is more easily made and which has a longer service life.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A method of forming a jumper comprising the steps of arranging a series of individual conductors around a hollow core, placing a conductor sleeve over each end of the arranged conductors, crimping the sleeve to reduce the diameter thereof and to arrange the individual conductors as a more compact and generally uniform circular annulus at each end, and then soldering the sleeved annulus at each end into a termination.

2. A method as set forth in claim 1 including the step of crimping the sleeve only partially axially to leave a flared inner end on the sleeve.

3. A method as set forth in claim 2 including the step of capturing a plastic sleeve inside the inner end of said conductive sleeve as it is crimped.

4. A method as set forth in claim 3 wherein said individual conductors are copper stranded cable.

5. A method as set forth in claim 4 wherein said core is a coil spring.

6. A method as set forth in claim 5 including the step of cutting an outer end of each sleeve after crimping to form a true circular face normal to the sleeve.

7. A method as set forth in claim 6 wherein said termination includes a socket into which said true face and crimped sleeve is inserted and soldered.

8. A method as set forth in claim 7 wherein said socket includes a fitting means for an end of core.

9. A method as set forth in claim 7 wherein said crimping creates solder receiving pockets in the exterior of said conductor sleeve in cooperation with the socket in the termination.

10. A method as set forth in claim 9 wherein said pockets are formed between small axial ridges on the exterior of said conductor sleeve.

11. A method as set forth in claim 10 including the step of spiralling the conductors about the core after crimping the conductor sleeve on one end but before crimping the conductive sleeve on the other end.

12. A method as set forth in claim 11 including the step of placing the jumper in a hose, and sealing the hose at each termination, for circulation of water therethrough.

13. A jumper comprising a series of individual cut to length conductors surrounding a hollow core, a conductor sleeve at each end of the jumper surrounding the conductors as a more compact and generally uniform density annulus surrounding the core at each end of the jumper, each sleeved end of the circular annulus being soldered into a termination.

14. A jumper as set forth in claim 13 wherein said sleeved ends of said conductors each terminate in a trued face soldered into a corresponding socket in each termination.

15. A jumper as set forth in claim 14 wherein each termination includes water fitting means and means to seal a hose to the termination.

16. A jumper as set forth in claim 15 wherein said water fitting means includes a riser tube adapted to telescope into the core and the sleeved end is soldered in.

17. A jumper as set forth in claim 13 wherein each conductor sleeve includes a flared inner end.

18. A jumper as set forth in claim 13 including a plastic sleeve surrounding said conductors as they exit the conductor sleeve.

19. A jumper as set forth in claim 13 wherein each conductor sleeve includes a flared inner end, and a plastic sleeve surrounding said conductors as they exit the conductor sleeve, said plastic sleeve being at least partially captured and constricted by the conductor sleeve.

20. A jumper as set forth in claim 13 wherein said conductors are copper stranded cable.

21. A jumper as set forth in claim 13 wherein said core is a coil spring.

22. A jumper as set forth in claim 13 including pockets formed in the exterior of the sleeves to receive solder.

23. A jumper as set forth in claim 22 wherein said pockets are formed by slight axial ridges on the exterior of the conductor sleeves.

* * * * *